United States Patent [19]

Reed

[11] 3,981,116

[45] Sept. 21, 1976

[54] SHEATHING SYSTEM FOR BUILDING STRUCTURES

[75] Inventor: Charles Paul Reed, Scarborough, Canada

[73] Assignee: Alcan Aluminum Corporation, Cleveland, Ohio

[22] Filed: June 17, 1974

[21] Appl. No.: 479,639

Related U.S. Application Data

[63] Continuation-in-part of Ser. No. 370,164, June 14, 1973, abandoned.

[52] U.S. Cl. ..... 52/484

[51] Int. Cl.[2] ..... E04B 5/52

[58] Field of Search ..... 52/479, 508, 537, 536, 52/539, 521, 520, 519, 477, 345, 275, 485; 248/317, 323, 326, 343

[56] References Cited

UNITED STATES PATENTS

| | | | |
|---|---|---|---|
| 460,283 | 9/1891 | Adler | 52/529 |
| 2,212,982 | 8/1940 | Drain | 52/275 |
| 2,307,653 | 1/1943 | Wright | 52/484 |
| 2,362,252 | 11/1944 | Ellinwood | 52/288 |
| 2,591,361 | 4/1952 | Knott | 52/520 |
| 2,620,906 | 12/1952 | Ketchum | 52/520 |
| 2,822,584 | 2/1958 | Urbain | 52/484 |
| 2,857,995 | 10/1958 | Boulton | 52/520 |
| 3,049,341 | 8/1962 | Kemp | 52/484 |
| 3,394,519 | 7/1968 | Tischuk | 52/520 |
| 3,395,504 | 8/1968 | Zwickert | 52/484 |
| 3,452,500 | 7/1969 | Heirich | 52/520 |
| 3,603,057 | 9/1971 | Curran | 52/478 |

FOREIGN PATENTS OR APPLICATIONS

| | | | |
|---|---|---|---|
| 1,285,038 | 1/1962 | France | 52/275 |

*Primary Examiner*—John E. Murtagh

[57] ABSTRACT

A sheathing system is provided for covering structure of a building. The system includes elongated panels that can be arranged edge to edge to form a generally planar surface which can be moisture tight for convenient washing. The panels are rigidly supported from the building structure so that said generally planar surface does not move if subjected to the pressure of a jet of water. The panels can run transversely to rigid elongated stringers which are spaced from the building structure so that they can clear irregularities on the building structure. Between such stringers and the building structure are spacers that are of relatively short length measured along the lengths of the stringers, and that can slide along the stringers to suitable locations for connection to the building structure. The spacers may be rigid spacers. Where the panels are arranged as a drop ceiling, below ceiling structure of a building, some or all of the spacers may be stiff hangers which are adjustable in length and have upper ends swingable relative to the ceiling structure and lower ends swingable relative to and slidable along the stringers, but when the drop ceiling panels are secured to the stringers the entire system is rigid. The system is particularly suitable for food processing plants, and can provide a water tight sheath for both the ceiling and the walls of a room.

19 Claims, 16 Drawing Figures

Fig. 9.
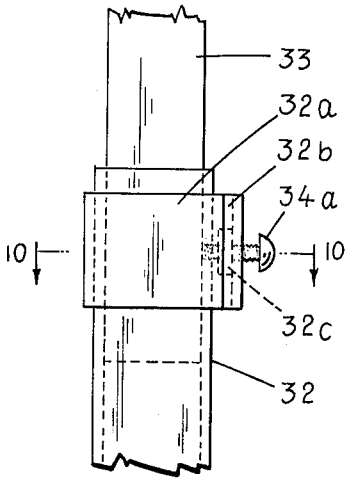
Fig. 10.
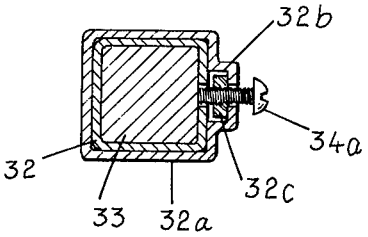
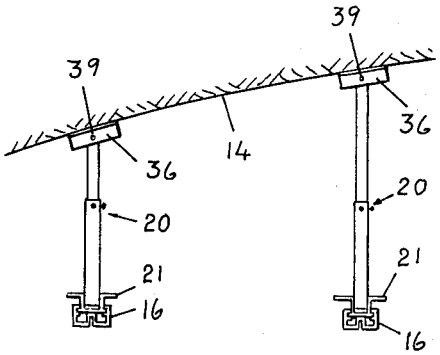
Fig. 11.
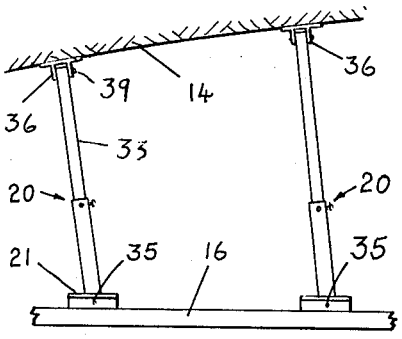
Fig. 12.
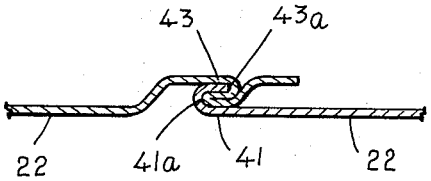
Fig. 13.

SHEATHING SYSTEM FOR BUILDING STRUCTURES

CROSS-REFERENCES TO RELATED APPLICATIONS

This application is a continuation-in-part of the Charles Paul Reed U.S. Pat. application Ser. No. 370,164 filed June 14, 1973, now abandoned.

BACKGROUND OF THE INVENTION

1. Field of the Invention

This invention relates to a sheathing system for building structures, and is particularly concerned with a system suitable for use in food processing plants where the ceiling, or ceiling and walls, should be durable and easy to clean.

2. Description of the Prior Art

In a food processing plant it is important that the ceiling be kept clean and free of peeling paint or foreign matter. In some situations, heat, steam or other conditions within a room may cause the condition of the ceiling to deteriorate seriously. The structure of the ceiling may become uneven and foreign matter may become lodged in it, and it may become necessary to shut down the plant to clean and repair the ceiling. The condition of the walls in such a plant may also give rise to problems of cleanliness.

The problem of unsightly wall and ceiling structures arises in other situations, where it would be desirable to be able to conceal such structures with a system having components that can if desired be precut and easily installed despite irregularities of the structure to be covered.

SUMMARY OF THE INVENTION

The present invention provides a sheathing system wherein elongated panels are arranged edge to edge in a plane, being supported by elongated rigid stringers transverse to and concealed by the panels, the stringers being rigidly supported by spacers extending between the stringers and the ceiling structure or wall structure to be sheathed. Such a system can cover both ceiling and wall structures of a room, providing moisture tight surfaces that can easily be cleaned. The spacers enable the stringers to straddle projections on the ceiling or wall structures. For a drop ceiling the spacers are stiff hangers which during installation can swing and be adjusted in length so that the drop ceiling can be perfectly level but which, when the installation is complete, hold the drop ceiling rigidly so that it does not move when being washed from below.

BRIEF DESCRIPTION OF THE DRAWINGS

Preferred embodiments of the invention are illustrated by way of example in the accompanying drawings in which:

FIG. 9 is a side view of parts of a modified hanger for use in the drop ceiling system;

FIG. 10 is a section along the line 10—10 of FIG. 9;

FIG. 11 is a vertical section through part of a room having an inclined ceiling and illustrates the installation of hangers and stringers to provide a horizontal drop ceiling;

FIG. 12 is a vertical section at right angles to FIG. 11;

FIG. 13 is a section through the interlocked edges of a pair of adjacent ceiling or wall panels;

DESCRIPTION OF THE PREFERRED EMBODIMENTS

Figure 1:
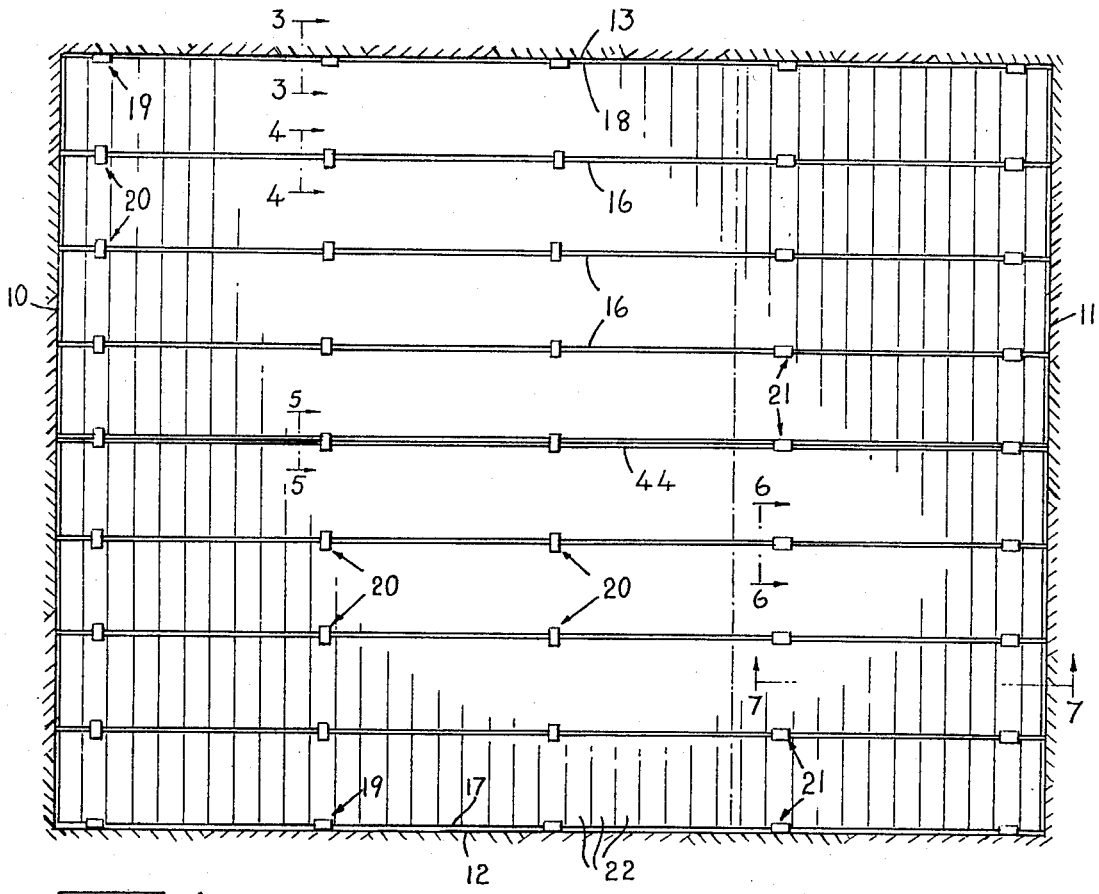
FIG. 1 is a plan of a rectangular room having a drop ceiling installed therein.
Figure 2:
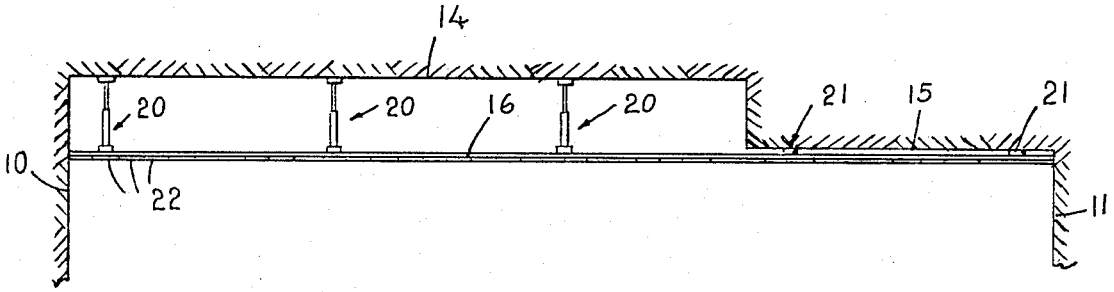
FIG. 2 is a vertical section through the room and drop ceiling of FIG. 1.

The room illustrated in FIGS. 1 and 2 has end walls 10, 11 and side walls 12, 13. The ceiling structure includes an elevated portion 14 and a lower portion 15, an irregular ceiling structure being illustrated to show how a drop ceiling system of the invention can be accommodated to it.

Running longitudinally of the room, in a horizontal plane, are rigid elongated parallel stringers 16, including two stringers 17 and 18 located alongside the opposite side walls 12 and 13 respectively. Supporting the stringers 17 and 18 from the elevated ceiling structure 14 are elongated spacers or hangers 19; the remainder of the stringers 16 are supported from the elevated ceiling structure by other spacers or hangers 20 which differ slightly from the hangers 19 as will be explained by reference to FIGS. 3 and 4. Supporting the stringers 16, 17 and 18 from the lower ceiling structure 15 are rigid spacer shoes 21 best illustrated in FIGS. 6 and 7. Secured to the undersides of the stringers 16, 17, 18 are drop ceiling panels 22, best illustrated in FIG. 8, running transversely to the stringers between the side walls 12, 13.

Figure 6:
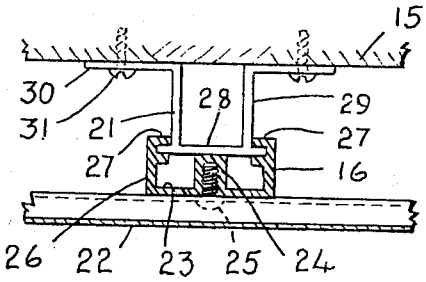
FIG. 6 is a further enlarged section along the line 6—6 of FIG. 1.
Figure 7:
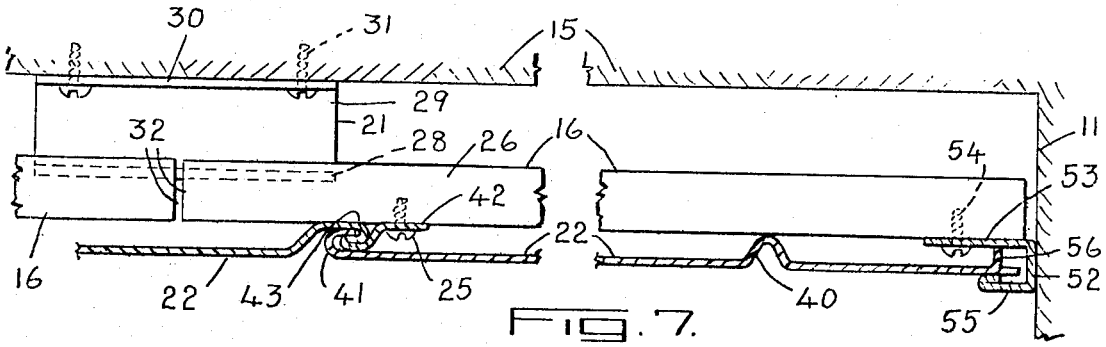
FIG. 7 is a similar enlarged section, partly broken away, along the line 7—7 of FIG. 1.

The stringers 16, 17 annd 18 are constituted by identical aluminum extrusions that are generally channel-shaped in cross-section. Referring to FIG. 6, a stringer has a plane base 23 with an inverted narrow longitudinal channel 24 raised therein to receive self-tapping screws 25 which secure the drop ceiling panels 22 to the stringers, as more fully described below, the panels 22 concealing the stringers from below. Each stringer has parallel side walls 26, and each side wall 26 has an inwardly facing longitudinal channel 27 therein for slidably receiving the plane head portions 28 of spacer shoes 21. The spacer shoes 21 are rigid channel-shaped aluminum extrusions, having parallel leg portions 29 and horizontal foot portions 30 whereby the shoes 21 can be affixed by screws 31 to the lower portion 15 of the ceiling structure. As shown in FIG. 7, a spacer shoe 21 may span and support the ends 32 of aligned stringers 16 where a single stringer is of insufficient length to extend betweeen the end walls 10, 11 of the room. The stringer ends 32 are spaced slightly apart to accomodate thermal expansion.

Figure 4:
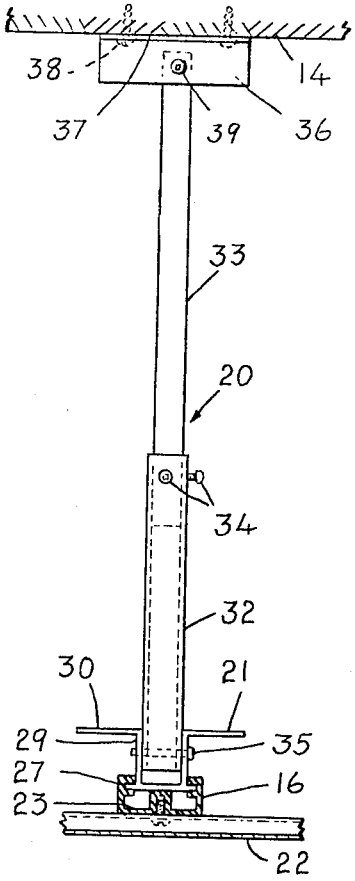
FIG. 4 is a similar enlarged section along the line 4—4 of FIG. 1.
Figure 8:
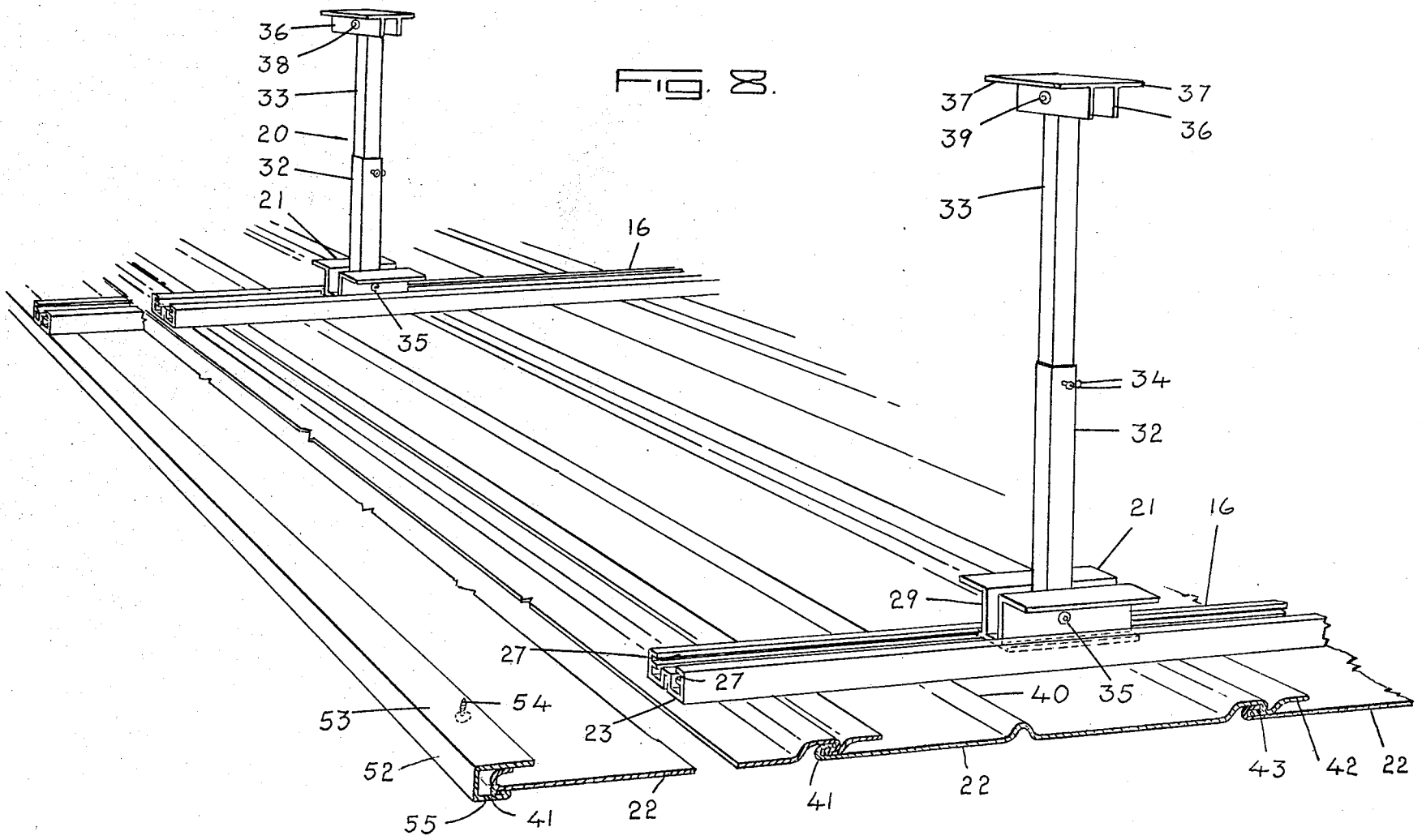
FIG. 8 is a perspective view of parts of the drop ceiling supporting system.

Now considering FIGS. 4 and 8, each of the elongated hangers 20 has at its lower end a hanger shoe 21 identical to the spacer shoe 21 of FIG. 6, so that the lower end of the hanger is received in the channels 27 of a stringer 16 and is slidable therealong. Each hanger 20 includes a pair of rigid elongated members, namely a lower tubular member 32 and an upper rodlike member 33 telescopically received within the member 32 so that the members 32, 33 are relatively adjustable longitudinally of each other to vary the length of the hanger. To fix the length of the hanger, screw fasteners 34, threaded through the member 32, can be tightened against the member 33, firmly fastening the members 32, 33 together. A preferred means for fastening the members 32, 33 together is shown in FIGS. 9 and 10, where a collar 32*a* is provided around the tubular member 32, the collar having a longitudinal channel 32*b* in which square nut 32*c* is located but cannot rotate. A screw 34*a* passes freely through aligned holes in the collar 32*a* and member 32, but is threaded through the nut 32*c*, and the screw can be tightened against the rodlike member 33. This arrangement provides a very strong connection between the members 32, 33 which may be of lightweight material such as aluminum. When, as in refrigerated rooms, it is desirable to have thermal insulation between the drop ceiling and the upper ceiling structure 14, the rodlike member 33 can be of thermally insulative material such as nylon.

Referring again to FIGS. 4 and 8, the lower hanger member 32 is pivotally connected to the shoe 21 by a shoe pivot pin 35 the axis of which is transverse to the length of the stringer 16. The upper hanger member 33 is pivotally connected at its upper end to a bracket 36 having flanges 37 that can be rigidly connected to the elevated ceiling structure 14 by screws 38. The pivot pin 39 of the bracket 36 has its axis fixed parallel to the length of the stringers 16. The pivot pins 39, 35, together with the adjustable lengths of the hangers 20, permit the stringers 16 to be arranged with their bases 23 horizontal despite unevenness of the ceiling structure 14. If, for example, the sturcture 14 as viewed in FIG. 4 is at an inclination to the horizontal, as shown in FIG. 11, the brackets 36 can be tilted while the longitudinal axes of the hangers 20 are in vertical planes running longitudinally of the stringers 16, the hangers 20 being adjusted in length so that the drop ceiling can be perfectly horizontal. If the ceiling structure 14 is also inclined to the horizontal along a line in the vertical plane of a stringer, as shown in FIG. 12, the hangers 20 are tilted in said plane but the pivots 35 of shoes 21 permit the stringers 16 to be horizontal. It may be convenient to provide the upper end of hanger member 33 with two holes (not shown) at right angles to each other so that the pivot 39 can be inserted at the installation site either normal to pivot 35 (as in FIG. 4) or parallel thereto (as in FIG. 3).

Figure 3:
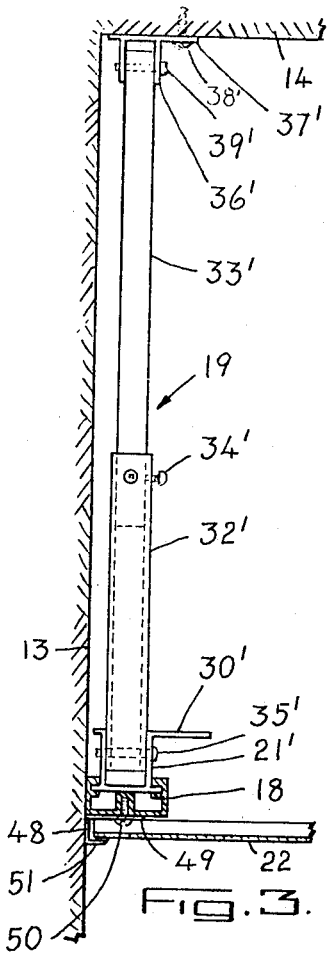
FIG. 3 is an enlarged section along the line 3—3 of FIG. 1.

As can be seen in FIG. 3, the hangers 19 for the stringers 17, 18 adjacent the side walls 12, 13 differ slightly from the hangers 20. The shoes 21′ at the lower ends of the hangers 20 have one flange or foot portion 30′ removed so as to clear the wall. The telescopic members 32′, 33′ of hangers 19 are the same as those of hangers 20, being fastenable together by screw fasteners 34′. Their brackets 36′ at the upper end are turned 90° to the brackets 36 of hangers 20, with a flange 37′ removed so as to clear the wall. Their upper pivots 39′ are fixed parallel to their lower pivots 35′, so that the hangers 19 can accommodate unevenness of the ceiling structure 14 in a plane normal to the paper as viewed in FIG. 3. Unevenness of the ceiling structure 14 in the plane of the paper can if necessary be cured by patching the ceiling structure 14 adjacent the side walls of the room, but this would be a rare requirement, particularly having regard to the fact that the hangers 19 can be shifted along the stringers to suitable positions under the ceiling structure before being connected to the latter by screws 38′. Because the hangers 19 cannot swing relative to the ceiling structure 14 in the plane of the paper (FIG. 3), and because the hangers 20 cannot swing relative to the ceiling structure 14 normal to the paper (FIG. 4), all swinging relative to the ceiling is eliminated when the lower ends of the hangers are interconnected by installation of the drop ceiling panels 22, which are rigidly secured to the stringers to prevent relative movement between the panels and stringers.

As can be seen in FIG. 2, compared to the lengths of the elongated stringers 16 the spacer shoes 21 are of relatively short lengths. Because the spacer shoes slidably engage the stringers, during installation of the stringers the positions of the spacer shoes therealong can be adjusted to locations where the foot portions 30 (FIG. 6) of the spacer shoes can be fixed to solid portions of the building structure 15. If the surface of structure 15 is uneven, the spacer shoes 21 can be adjusted to positions along the stringers where, with the foot portions 30 fixed to the structure 15, the head portions 30 fixed to the structure 15, the head portions 28 of the spacer shoes hold the stringers rigidly in a plane spaced from the uneven surface of structure 15. The relatively short lengths of the spacer shoes enables the shoes to be fixed to localities on the structure 15 that are relatively flat. This advantageous arrangement will be referred to again when discussing FIG. 16. If the structure 15 of FIG. 2 is extremely uneven, the stringers 16 can be lowered sufficiently to enable short hangers similar to the hangers 19, 20 to be used between the stringers and the structure 15.

The drop ceiling panels 22 are preferably aluminum pans having bottom surfaces coated with durable baked enamel, which has a long life and does not peel or crack despite adverse conditions in the room below. The pans are fashioned to meet and interlock along their longitudinal edges thus to prevent penetration of solids or fluids through the drop ceiling into the space above it. As can be seen in FIG. 8, a typical panel 22 consists of a generally flat elongated sheet having a central longitudinal stiffening rib 40. One longitudinal edge of the panel forms a retroverted flange portion defining a U-shaped channel 41. The other longitudinal edge 42 is jogged upwardly, and adjacent this edge the panel has a retroverted flange portion which forms another U-shaped channel 43. As best seen in FIG. 7, the jogged edge 42 of one panel provides a longitudinally extending means which can be secured to the stringers 16 by self-tapping screws 25 to support the panel, and the channel 41 of another panel can be hooked into the channel 43, interlocking the panels and concealing the screws 25 from below. The snug fit between the channels 41 and 43 provides an excellent moisture seal along the joint between adjacent panels. An even better seal is provided by the arrangement of the longitudinal edges shown in FIG. 13, where one leg of each U-shaped channel 41, 43 bottoms in the other, as at 41*a*, 43*a*, to provide a line of contact therealong. Such lines of contact can be ensured by careful rolling of the edges of the panels, and of course by ensuring that each panel, before it is fastened to the stringers, is fully interlocked with the previously installed panel. If desired, a flexible sealing tape (not shown) may be roll formed along the panel edge at 43*a* to further improve the seal when trapped on assembly of the panels between the flanges forming the channels 41 and 43.

The self-tapping screws 25 (FIG. 7) can, if pointed at the ends, be driven through the panel edges 42 without provision of predrilled holes in the edges 42, and the screws thread into the walls of channels 24 (FIG. 6) of the stringers to be retained therein.

Figure 5:
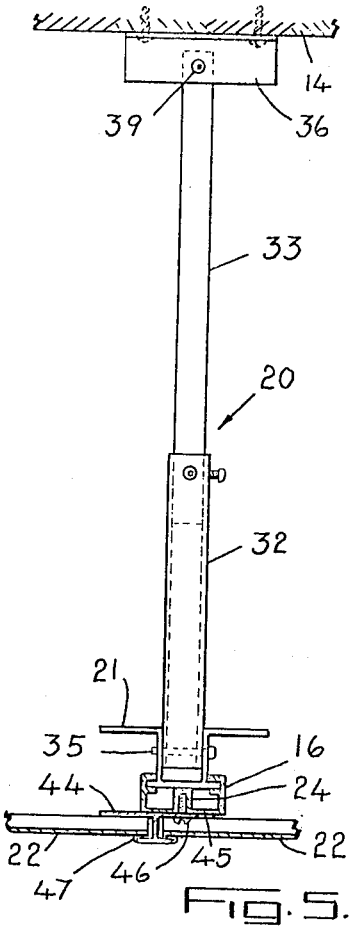
FIG. 5 is a similar enlarged section along the line 5—5 of FIG. 1.

If the panels 22 are not long enough to span the distance between the side walls 12, 13 of the room, panels can be arranged end to end using an intermediate supporting strip 44 shown in FIG. 5. The strip 44 has upper horizontal flanges 45 one of which is fastened to a stringer 16 by self-tapping screws 46 threaded into the inverted channel 24 of the stringer. The strip 44 also has lower flanges 47 which define channels with the upper flanges 45 for snugly receiving the ends of panels 22. At their other ends, as illustrated in FIG. 3, the panels 22 are supported in strips 48 which abut the side walls 12, 13 of the room. Each strip 48 has an upper flange 49 held by self-tapping screws 50 to a stringer 17 or 18, and has a lower flange 51 which, with upper flange 49, defines a channel for snugly receiving the ends of panels 22.

Along one of the end walls 10 of the room is a strip 52 shown in FIG. 8. The strip 52 has an upper flange 53 fixed to the undersides of the stringers by self-tapping screws 54. A lower flange 55 spaced from the upper flange 53 defines a channel for the snug reception of a curled side edge 41 of a panel 22. Along the opposite end wall 11, as shown in FIG. 7, is another strip 52 affixed by screws 54 to the stringers. The last panel 22 to be installed will usually have to be cut to be of suitable width, and, along the cut edge, tabs 56 (FIG. 7) are cut and bent upwardly at intervals along the edge to hold this last panel down against the lower flange 55 of the strip 52.

The sequence of installing the drop ceiling system will now be described. The dimensions of the room being known, it is possible to precut at the factory the lengths of the stringers 16, 17, 18, the panels 22, and the panel supporting strips 44, 48, 52. At the installation site, with the stringers on the floor, the shoes 21 of hangers 19, 20 are slid along the stringers 16, 17, 18 to approximately their final positions, the fasteners 34, 34' are temporarily tightened, and the spacer shoes 21 for the lower ceiling structure 15 are also slid into approximately their desired positions along the stringers. Then, one after another, the stringers are raised (with a man at each end) and the brackets 36, 36' at the upper ends of the hangers are screwed to the ceiling structure 14. The stringers, supported by the hangers 19, 20, are then adjusted to lie parallel to one another in a horizontal plane, at the correct distance below the lower ceiling structure 15. This adjustment is achieved by adjusting the lengths of the hangers 19, 20, it being immaterial that the hangers may not be perfectly vertical because of the pivotal action at the pivot pins 35, 39, 35', 39'. When the stringers have been levelled, and have been fastened through spacer shoes 21 to the lower ceiling structure 15, the drop ceiling panels 22 can be installed. A strip 52 is attached to the stringers alongside wall 10 (FIG. 8), and the strips 48, 44 which are to receive the ends of panels 22 are attached to stringers adjacent the wall 10, but are left free at their ends remote from the wall 10. A first panel 22 is slid into position with its curled edge 41 in the strip 52, and its jogged edge 42 is then screwed to the stringers. The next panel is slid into interlocking connection with the first, the panels and end strips 48, 44 being flexible and resilient so that there is no difficulty in pressing the panels into place. As panels are progressively installed the end strips 48, 44 are progressively affixed along their lengths to the stringers, the screws 50, 46 which affix them being concealed by the panels subsequently installed beneath them. When all panels but the last have been installed, a strip 52 is secured in place along wall 11 (FIG. 7), and the last panel, in which tabs 56 have been fashioned, is flexed and snapped into position. To ensure moistureproof joints along the strips 44, 48, 52, caulking may be pressed into the joints.

The connection of the hangers to the ceiling structure and to the stringers through the pivot pins 35, 39, 35', 39' permits swinging of the upper ends of the hangers relative to the ceiling structure and swinging of the lower ends of the hangers relative to their upper ends and to the stringers, the lower ends of the hangers also being slidable along the stringers. However with the fasteners 34, 34' tightened the hangers have no end play, i.e., the hangers are not vertically movable longitudinally of themselves relative to the ceiling structure and to the stringers, and then they rigidly space the stringers away from the ceiling structure. The longitudinal rigidity of the hangers facilitates the upward insertion of screws into the stringers during installation of the drop ceiling panels. With the panels installed, the entire system is rigid, the stringers and panels cannot move vertically relative to the ceiling structure, and thus the drop ceiling is able to withstand, for example, the force of a water jet from below, or the force of scrubbing from below, during cleaning of the enamelled lower surfaces of the panels.

Figure 14:
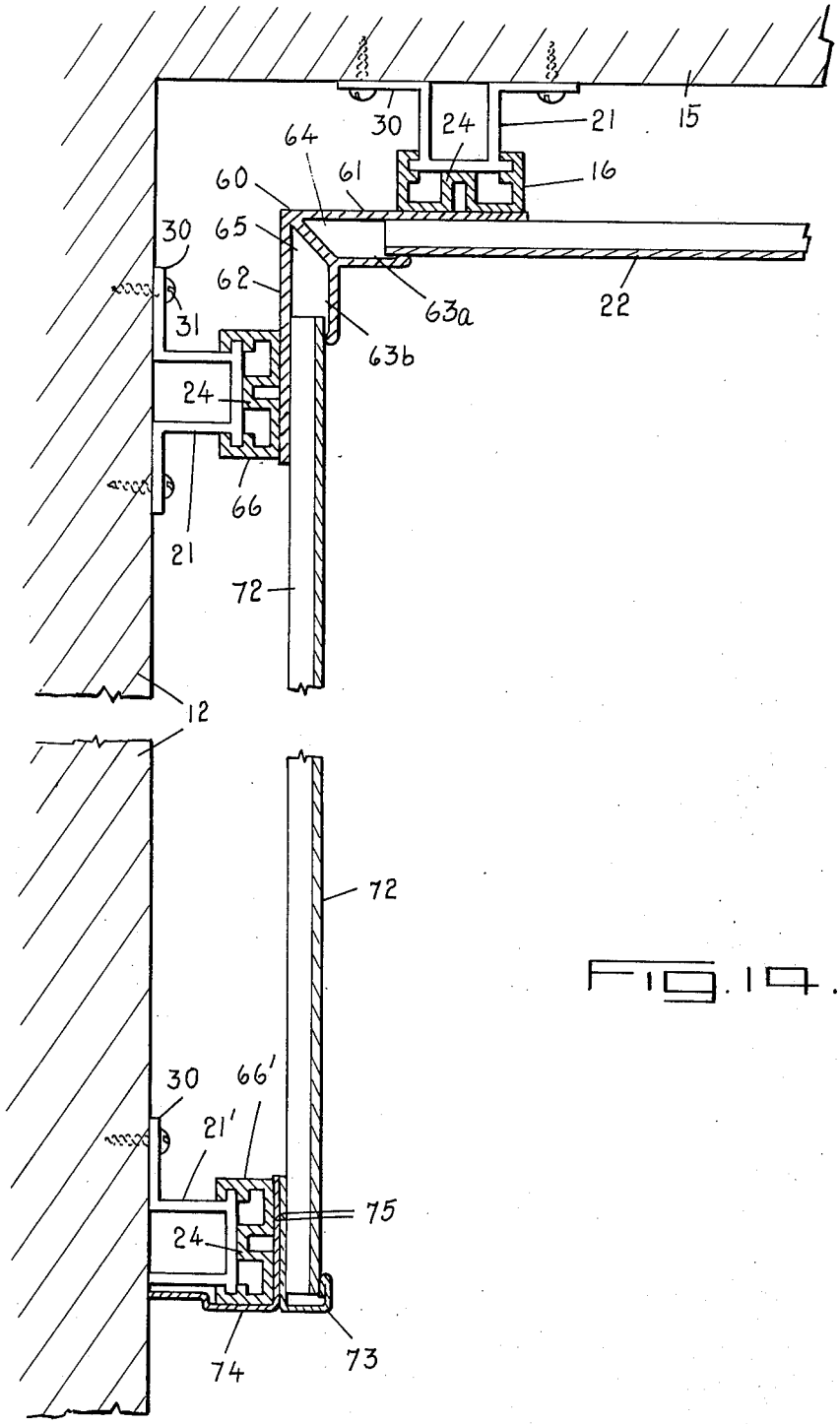
FIG. 14 is a vertical section showing a ceiling and wall structure of a room and a sheathing system therefor, parts being broken away.

With the moisture tight drop ceiling installed, the wall structures 10, 11, 12, 13 may also be covered with moisture tight sheaths, with seals between the latter and the drop ceiling so as to provide a moisture tight sheath for the ceiling and wall structures of the room. FIG. 14 illustrates a preferred sheathing system for covering both a ceiling structure 15 and adjoining wall structures 12 of a room. Arranged in a horizontal plane below the ceiling structure is a first set of elongated ceiling panels 22. These panels are mositure impervious and their longitudinal edges are sealingly joined together, as illustrated for example in FIG. 13, to provide a moisture tight ceiling surface spaced below the ceiling structure 15. The panels 22 are supported from the ceiling structure 15 by stringers 16 running transversely to the panels, and by rigid spacers 21 located between the stringers and the ceiling structure, as has already been described by reference to the right hand end of FIG. 2 and by reference to FIGS. 6 and 7. However, adjacent the walls the construction has been altered in FIG. 14. The ends of the panels 22 engage rigid, elongated angle members 60, one of which is shown in cross-section in FIG. 14. One arm 61 of this angle member is secured to a ceiling stringer 16 by self-tapping screws (not shown) driven through the arm 61 into the stringer channel 24, and another angle arm 62 is similarly secured to a horizontal wall stringer 66 that is identical to stringer 16 and is spaced from the wall structure 12 by rigid spacers 21. These spacers 21 can be identical to the spacers 21 already described with reference to FIGS. 6 and 7. The angle member 60 is preferably an extruded aluminum piece, and has beteween its arms 61, 62 a web that is bifurcated, as at 63*a*, 63*b*, so as to have a horizontal channel 64 for sung reception of the ends of the ceiling panels 22, and a vertical channel 65 for snug reception of the ends of wall panels 72 that are similar to the ceiling panels 22.

The wall panels 72 constitute an additional set of moisture impervious panel. Panels 72 run vertically, in a plane spaced inwardly from the wall structure 12. At their upper ends the panels 72 are secured by self-tapping screws (not shown) driven into the channel 24 of stringer 66. The panels 72 can be sealingly joined together edge to edge as illustrated in FIG. 13 to provide a moisture tight wall surface. Several stringers (not shown) parallel to the stringer 66 and identical thereto can be secured to the wall structure, by spacers 21, at different elevations, to support the panels 72 in a plane spaced inwardly from the wall structure 12, and at their lower ends, the panels 72 are rigidly secured to another such horizontal stringer 66′, rigidly spaced from the wall structure by spacers 21′. The spacers 21′ are identical to the spacers 21 except that one foot portion 30 thereof is removed.

The lower ends of the wall panels 72 are overlapped by a strip of J-trim 73 and this, together with another roll formed trim section 74 that extends to the wall structure 12, provides a seal at the lower ends of the panels 72 when they extend only part way down the wall structure. The trim sections 73, 74 have arms 75 fixed to the stringer 66′ by self-tapping screws (not shown) that are driven into the stringer channel 24. If the panels 72 extend to the floor, the J-trim 73 abuts the floor and provides a seal, and the other trim section 74 is not required. However, in food processing plants and other locations where the lower parts of the wall may be subjected to impacts (e.g. from vehicles) it may be advantageous to terminate the lower ends of panels 72 at an elevation where the panels are not likely to be damaged. However, the panels 22, 72 are able to deflect when struck, rather than breaking.

Figure 15:
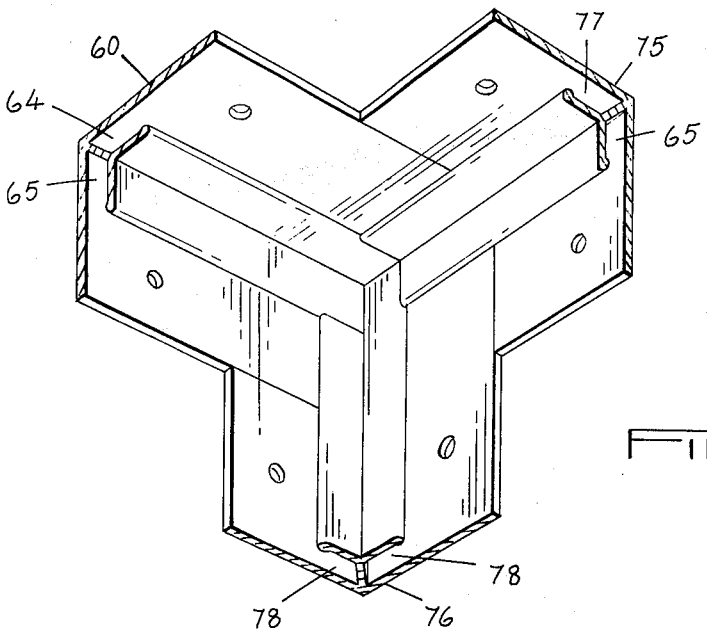
FIG. 15 is a perspective view of angle members of the system of FIG. 14 meeting at a corner of the room.

It will be seen that the angle member 60, with its channels 64, 65 into which the panels 22, 72 fit, and with its arms 61, 62 bridging the corner between stringers 16 and 66, provides a sealing bridge between the ceiling surface provided by panels 22 and the wall surface provided by panels 72. FIG. 14 illustrates the sheathing of the ceiling structure 15 and one wall 12, but of course it is usually desired to sheath other walls as well. This is accomplished by installing angle members similar to the member 60 along the other walls, as well as down the junctures between walls, as illustrated in FIG. 15 which shows, at a corner of a room, the angle member 60 meeting a similar horizontal angle member 75 and a similar vertical angle member 76. The ends of the angle members are cut to fit against one another, providing the horizontal channel 64 for the end of ceiling panels 22, a horizontal channel 77 for an edge of a ceiling panel (compare the channel provided by strip 52 in FIG. 7), vertical channel 65 for the upper ends of wall panels 72, and channel 78 for the edge of such a wall panel. In installing the sheathing system, the stringers 16, 66 are first fixed in place by their spacers 21, the angle members 60, 75, 76 are fixed to stringers, and then the metal panels can be installed, these panels having sufficient flexibility and resilience to be fitted into the channels of the angle members. The resilient trim sections 73, 74 are also affixed to the stringer 66′ before the wall panels are installed. To ensure that the resultant sheathing system is moisture tight, high pressure caulking may be applied as required along any of the perimetral joints. Some or all of the stringers 16 of FIG. 14 may be supported from ceiling structure above them by spacers such as the hangers 20, as previously described with reference to FIGS. 1 to 5 and 8.

Figure 16:
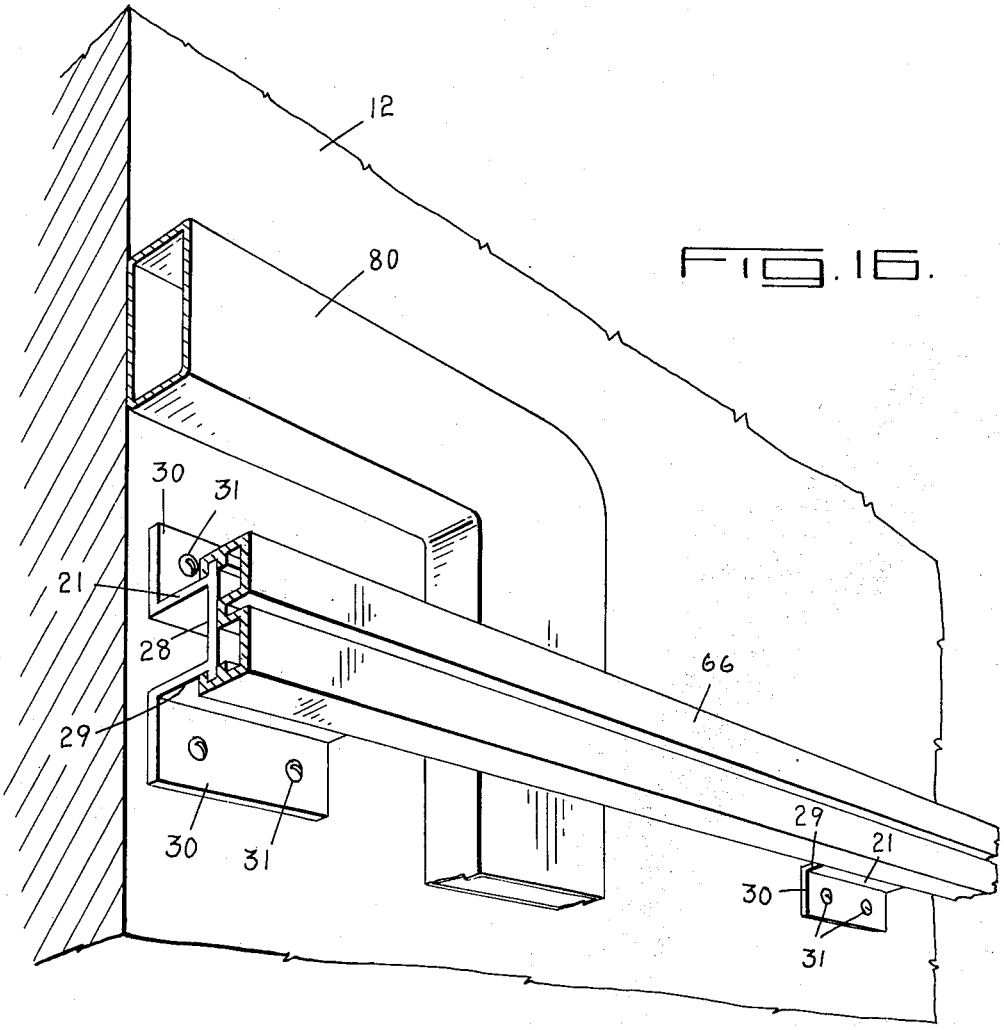
FIG. 16 is a perspective view illustrating how stringers of the system can be supported to straddle ducts or other projections from a wall structure.

FIG. 16 illustrates the value of spacing stringers, such as a stringer 66, away from the building structure 12. Spacers 21 can be sufficiently tall, between their foot portions 30 and their head portions 28, that the stringers clear ductwork 80 or other irregularities on the surface of the building structure. If spacers were not provided for supporting the stringers and panels, such irregularities would be a serious impediment to sheathing the building structure. Because the spacers hold the stringers and panels away from the building structure, insulating material may if desired be installed between the building structure and the panels, as for example by foaming polyurethane in place behind the panels. The spacers can be of relatively short lengths (measured longitudinally of the stringers) compared to the stringers. If there are numerous projections (wiring, pipes, columns, etc.) from the building structure, the relatively short spacers 21 can be slid along the stringers to locations between such projections where they can be fastened to the building structure. The sliding engagement of the spacers with the stringers makes it possible to adjust the locations of the spacers to favourable spots for securement to the building structure. This is useful for structures which have random solid portions to which spacers can be satisfactorily secured, and other portions where securement would be poor or impossible. Where the structure 12 has an irregular surface, the short spacers can be moved to, and fixed at, surface portions that are substantially coplanar, so that the parallel stringers 66 can be coplanar. For very irregular surfaces it may be necessary to employ spacers 21 having leg portions 29 of differing lengths, or to insert blocks between some of the spacers and the walls and drive long anchors 31 through the blocks and into the wall structure. A sheathing system such as that of FIG. 16 can of course be used for exterior as well as interior walls, and in some cases it may be desirable that the sheath can breath rather than being moisture tight. It may also be desirable to use spacers 21 that are somewhat longer than those illustrated in FIG. 16, so that a spacer can span three or four bricks, for example, where the wall structure 12 may include some loose bricks.

Modifications of the preferred embodiments will readily occur to those skilled in the art and are intended to be encompassed by the following claims.

What I claim as my invention is:

1. A drop ceiling system for installation below a ceiling structure, comprising a plurality of rigid elongated stringers that are to be arranged parallel to one another in a horizontal plane, a plurality of elongated hangers for supporting the stringers from the ceiling structure, each hanger comprising a pair of rigid members that are relatively adjustable longitudinally of the hanger to vary the length of the hanger, hanger connecting and fastening means for connecting an upper end of the hanger to the ceiling structure and a lower end of the hanger to a stringer and including means slidingly engageable with a stringer to allow adjustment of the position of the hanger longitudinally of the stringer, the hanger connecting and fastening means permitting swinging of one end of the hanger relative to the other during installation to accomodate unevenness in the ceiling structure and including means for firmly fastening said rigid members together to fix the length of the hanger, the hanger connecting and fastening means when said rigid members are fastened together preventing vertical movement of the hanger longitudinally of itself relative to the ceiling structure and to the stringer whereby the hangers can rigidly space the stringers away from the ceiling structure, a plurality of moisture imprevious drop ceiling panels, means for rigidly securing the panels to the stringers to form a continuous drop ceiling and prevent relative movement between the panels and stringers, and means for sealing said drop ceiling against passage of moisture; the ceiling means, the impreviousness of the panels, the rigid securing of the panels to the stringers, and the rigid spacing of the stringers from the ceiling structure ensuring that the drop ceiling can be cleaned from below without displacement thereof and without passage of moisture therethrough.

2. A system as claimed in claim 1, wherein the slidingly engageable means comprise a pivot for the lower end of the hanger about an axis transverse to the stringer.

3. A system as claimed in claim 2, wherein the hanger connecting and fastening means further comprise a pivot for the upper end of the hanger.

4. A system as claimed in claim 3, wherein the pivots for the upper ends of the hangers of at least one of the stringers have axes parallel to the stringer.

5. A system as claimed in claim 4, wherein the pivots for the upper ends of the hangers of at least one of the stringers have axes transverse to the stringer.

6. A system as claimed in claim 5, wherein the drop ceiling panels are transverse to and conceal the stringers from below.

7. A system as claimed in claim 6, wherein the means for securing the panels to the stringers are concealed from below by the panels.

8. A system as claimed in claim 1, wherein the sealing means comprise interlocking longitudinal edges of the panels.

9. A system as claimed in claim 3, wherein the pivots for the upper ends of some of the hangers have axes fixed parallel to the stringers and the pivots for the upper ends of others of the hangers have axes fixed transverse to the stringers.

10. A system as claimed in claim 1, wherein the pair of rigid members of each hanger are in inner member slidably adjustable within an outer member, and wherein the means for firmly fastening said rigid members together comprise a collar around the outer member, a nut nonrotatably held by the collar, and a screw extending through the collar and the outer member and threaded through the nut to be tightened against the inner member.

11. A system for supporting a drop ceiling below a ceiling structure of a room, comprising a plurality of rigid elongated stringers that are to be arranged parallel to one another in a horizontal plane, each stringer having a plurality of elongated hangers for supporting the stringer from the ceiling structure, each hanger comprising a pair of rigid elongated members that are relatively adjustable longitudinally of each other to vary the length of the hanger and fastening means for firmly fastening said rigid elongated members together to fix the length of the hanger, the lower ends of the hangers being swingable relative to and slidable along the stringers, the upper ends of the hangers being swingable relative to the ceiling structure, the hangers for at least one of the stringers being swingable at their upper ends about fixed parallel to the stringer and the hangers for another of the stringers being swingable at their upper ends about axes fixed transverse to the stringers, and means for securing drop ceiling panels to the stringers to prevent relative movement between the panels and stringers, the hangers and fastening means preventing vertical movement of the stringers and drop ceiling panels relative to the ceiling structure.

12. A system as claimed in claim 11, wherein said other of the stringers is a stringer located alongside a wall of the room.

13. A system as claimed in claim 11, wherein shoes at the lower ends of the hangers are slidable along the stringers and pivots connect the lower ends of the hangers to the shoes about axes transverse to the stringers, and brackets at the upper ends of the hangers are connectable to the ceiling structure and pivots connect the upper ends of the hangers to the brackets, the last mentioned pivots constituting said fixed upper axes.

14. A sheathing system for covering a ceiling structure and adjoining wall structures of a room, comprising a first set of elongated ceiling panels that are moisture impervious and can be arranged edge to edge in a plane below the ceiling structure, an additional set of elongated side panels that are moisture imprevious and can be arranged edge to edge in a plane inward from each wall structure, means for sealingly joining the edges of the panels of each set to provide moisture tight wall and ceiling surfaces, means for sealingly bridging between said wall and ceiling surfaces to provide a moisture tight sheath for the ceiling and wall structures, and means for supporting the panels from the ceiling and wall structures, wherein the means for supporting the panels comprise elongated rigid stringers, means for rigidly securing the panels to the stringers, transversely to the stringers, to conceal the stringers, and spacers locatable between the stringers and the ceiling and wall structures and securable to said structures and to the stringers, and wherein at least some of the spacers securable to the ceiling structure comprise elongated hangers, each hanger comprising a pair of rigid members that are relatively adjustable longitudinally of the hanger to vary the length of the hanger, hanger connecting and fastening means for connecting an upper end of the hanger to the ceiling structure and a lower end of the hanger to a stringer and including means slidingly engageable with a stringer to allow adjustment of the position of the hanger longitudinally of the stringer, the hanger connecting and fastening means permitting swinging of one end of the hanger relative to the other during installation to accommodate unevenness in the ceiling structure and including means for firmly fastening said rigid members together to fix the length of the hanger, the hanger connecting and fastening means when said rigid members are fastened together preventing vertical movement of the hanger longitudinally of itself relative to the ceiling structure and to the stringer whereby the hangers can rigidly space the stringers away from the ceiling structure.

15. A system as claimed in claim 14, wherein the means for sealingly bridging between said wall and ceiling surfaces comprise elongated rigid angle members having channels for snugly receiving the panels of each set.

16. A system as claimed in claim 14, wherein said additional set of side panels extends down the wall structure from said ceiling surface, and at their lower ends the side panels are rigidly secured to a horizontal stringer, and sealing trim overlaps said lower ends to complete said moisture tight sheath.

17. a system as claimed in claim 14, wherein the means for sealingly joining the edges of the panels comprise a longitudinally curled edge of one panel defining a U-shaped channel, and a reversely bent longitudinal edge of an adjacent panel defining another U-shaped channel, the U-shaped channels interlocking snugly together so that a leg of each U-shaped channel bottoms in the other U-shaped channel.

18. A system as claimed in claim 14, wherein the means for affixing the panels to the stringers comprise longitudinal channels in the stringers and self-tapping screws that can penetrate the moisture impervious panels and be retained in the stringer channels, and wherein the panels cover and conceal said screws.

19. A system as claimed in claim 14, wherein some of the spacers that are securable to said ceiling and wall structures comprise rigid spacers of relatively short lengths compared to the elongated stringers, the rigid spacers having head portions, leg portions extending away from the head portions, and foot portions that are spaced from the head portions by the leg portions, the head portions of the rigid spacers being slidingly engageable with the stringers for adjustment of the positions of the rigid spacers along the stringers to locations where the foot portions of the spacers can be fixed to said one structure with the head portions of the rigid spacers holding the stringers rigidly in a plane space from said one structure.

* * * * *